US009277814B2

(12) United States Patent
Winker

(10) Patent No.: US 9,277,814 B2
(45) Date of Patent: Mar. 8, 2016

(54) ADJUSTABLE CONTINUOUS SHELF MOUNTING SYSTEMS AND APPARATUSES RELATED THERETO

(71) Applicant: Aaron James Winker, Green Bay, WI (US)

(72) Inventor: Aaron James Winker, Green Bay, WI (US)

( * ) Notice: Subject to any disclaimer, the term of this patent is extended or adjusted under 35 U.S.C. 154(b) by 0 days.

(21) Appl. No.: 14/713,583

(22) Filed: May 15, 2015

(65) Prior Publication Data

US 2015/0335155 A1 Nov. 26, 2015

Related U.S. Application Data

(60) Provisional application No. 62/001,453, filed on May 21, 2014, provisional application No. 62/100,091, filed on Jan. 6, 2015.

(51) Int. Cl.

| | |
|---|---|
| ***A47B 43/00*** | (2006.01) |
| ***A47B 87/00*** | (2006.01) |
| ***A47B 57/34*** | (2006.01) |
| ***A47B 96/02*** | (2006.01) |
| ***A47B 96/06*** | (2006.01) |
| *A47B 57/06* | (2006.01) |

(52) U.S. Cl.

CPC ..... *A47B 87/005* (2013.01); *A47B 57/34* (2013.01); *A47B 87/00* (2013.01); *A47B 96/02* (2013.01); *A47B 96/021* (2013.01); *A47B 96/06* (2013.01); *A47B 96/061* (2013.01); *A47B 57/06* (2013.01)

(58) Field of Classification Search

CPC ..... A47B 87/00; A47B 96/02; A47B 96/06; A47B 57/06; A47B 87/005; A47B 57/34; A47B 96/021; A47B 96/061

USPC ..... 211/186, 187, 90.01–90.04, 134, 87.01, 211/103, 106.01; 108/108, 147.17, 107, 108/106; 248/220.42, 220.41, 220.21, 248/220.31

See application file for complete search history.

(56) References Cited

U.S. PATENT DOCUMENTS

| | | | | | |
|---|---|---|---|---|---|
| 855,994 | A | | 6/1907 | Sorrell | |
| 1,055,522 | A | | 3/1913 | Cumming | |
| 1,247,938 | A | * | 11/1917 | Curtenius | A47B 57/42 180/68.5 |
| 1,962,396 | A | * | 6/1934 | Katz | A47B 57/42 108/152 |
| 2,191,701 | A | * | 2/1940 | Wood | A47B 57/42 248/243 |
| 2,772,846 | A | | 12/1956 | Skar | |
| 2,783,961 | A | * | 3/1957 | Weber | A47B 57/42 108/108 |
| 2,837,219 | A | * | 6/1958 | Ferdinand | A47B 57/485 108/185 |
| 2,887,291 | A | * | 5/1959 | Holmquist | A47B 57/30 248/247 |
| 2,912,119 | A | * | 11/1959 | Robinson | A47B 96/028 108/135 |
| 2,997,269 | A | * | 8/1961 | Urbain | A47B 57/34 108/106 |

(Continued)

*Primary Examiner* — Joshua J Michener
*Assistant Examiner* — Devin Barnett
(74) *Attorney, Agent, or Firm* — Patentfile, LLC; Bradley C. Fach; Steven R. Kick

(57) ABSTRACT

In some embodiments an adjustable continuous shelf mounting system may comprise a wall standard comprising a plurality of upper slots and a plurality of lower slots. A support bracket comprising: a first support wing coupled to a first upper tongue configured to engage an upper slot of a wall standard and a first lower tongue configured to engage a lower slot of a wall standard; a second support wing coupled to a second upper tongue configured to engage an upper slot of a wall standard and a second lower tongue configured to engage a lower slot of a wall standard; and a shelf lip receiving valley formed between the first support wing and the second support wing. A shelf comprising a load bearing surface and a perimeter lip. The perimeter lip of the shelf is configured to be received in the shelf lip receiving valley of the support bracket.

19 Claims, 11 Drawing Sheets

(56) References Cited

U.S. PATENT DOCUMENTS 3,026,641 A * 3/1962 Keats ..... B65D 88/12 248/125.8
3,041,033 A * 6/1962 Schwartz ..... A47B 96/061 248/248
3,220,363 A * 11/1965 Gingher ..... A47B 96/027 108/108
3,255,722 A * 6/1966 Ferdinand ..... A47B 57/18 108/107
3,604,669 A * 9/1971 Asher ..... A47B 57/425 108/108
3,613,900 A * 10/1971 Chiu ..... A47B 57/56 108/106
3,648,419 A * 3/1972 Marks ..... E04B 2/78 211/153
3,652,048 A * 3/1972 Hartman ..... A47B 57/565 108/108
3,697,034 A 10/1972 Shell
3,729,161 A 4/1973 Christensen
3,900,112 A * 8/1975 Azzi ..... B65G 1/023 193/35 R
3,965,826 A * 6/1976 Markham ..... A47B 57/42 108/108
4,008,873 A 2/1977 Travaglio et al.
4,029,282 A * 6/1977 Dauth ..... A47F 5/0807 248/220.42
4,138,019 A * 2/1979 Smith ..... A47F 5/0807 211/190
4,348,001 A * 9/1982 Baldwin ..... A47F 1/12 108/109
4,349,171 A * 9/1982 Baldwin ..... A47B 57/44 108/109
4,378,925 A * 4/1983 Griffin ..... A47B 57/045 108/108
4,453,641 A * 6/1984 Rasmussen ..... A47F 1/12 211/151
4,515,494 A * 5/1985 Robilliard ..... A47B 57/402 211/187
4,595,107 A * 6/1986 Welsch ..... A47B 57/265 108/147.13
4,603,781 A * 8/1986 Ryan, Jr. ..... A47F 5/01 211/153
4,685,575 A * 8/1987 Kulbersh ..... A47F 5/08 108/152
5,072,839 A * 12/1991 Arnone ..... A47F 5/13 108/108
D338,792 S * 8/1993 Chap ..... D30/120
5,233,930 A * 8/1993 Wang ..... A47B 47/00 108/42
5,253,835 A * 10/1993 Herron, III ..... A47B 57/30 108/108
5,346,077 A * 9/1994 Randall ..... A47B 96/028 211/134
5,351,842 A * 10/1994 Remmers ..... A47F 5/08 108/152
5,415,302 A * 5/1995 Carlson ..... A47B 55/02 108/147.13
5,433,327 A * 7/1995 Benvenuti ..... A47B 57/42 108/108
5,502,622 A * 3/1996 Cromwell ..... H05K 7/1409 174/17 R
5,509,541 A * 4/1996 Merl ..... A47B 45/00 211/103
5,575,444 A 11/1996 Otema
5,592,886 A * 1/1997 Williams ..... A47B 57/52 108/108
5,597,077 A * 1/1997 Hartmann ..... A47F 5/0056 211/134
5,695,081 A * 12/1997 Alkalay ..... A47B 47/04 108/147.12
5,758,851 A * 6/1998 Remmers ..... A47B 61/003 211/105.1
5,797,503 A * 8/1998 Stevens ..... A47B 31/00 108/107
5,893,470 A * 4/1999 Peggs ..... A47B 96/028 211/90.01
6,082,690 A * 7/2000 Durin ..... H02G 3/263 211/90.01
6,196,141 B1 * 3/2001 Herron, III ..... A47B 57/42 108/108
6,241,108 B1 * 6/2001 Nakatani ..... A47B 57/265 108/108
6,260,488 B1 * 7/2001 Yang ..... A47B 57/545 108/107
6,302,036 B1 * 10/2001 Carson ..... A47F 1/12 108/107
6,364,136 B1 * 4/2002 Weshler ..... A47F 5/103 108/102
D470,348 S * 2/2003 Herron, Jr. ..... D8/381
6,540,093 B1 * 4/2003 Shumway ..... A47B 57/30 108/147.11
7,086,544 B1 * 8/2006 Doench ..... A47B 96/028 211/105.1
7,240,803 B2 * 7/2007 Stitchick ..... A47B 47/022 211/106
7,300,122 B2 * 11/2007 Vardon ..... A47B 96/021 108/108
7,494,019 B2 2/2009 Kessell et al.
7,497,344 B2 * 3/2009 Chen ..... A47B 57/40 108/108
7,523,903 B1 * 4/2009 Rindoks ..... A47B 96/028 211/187
7,540,244 B2 * 6/2009 Gregory ..... A47B 96/028 108/108
7,832,361 B2 * 11/2010 Stevens ..... A01K 15/02 108/55.3
7,900,783 B2 * 3/2011 Fernandez ..... A47B 45/00 108/108
8,038,021 B2 * 10/2011 Chen ..... A47B 46/005 211/187
8,479,928 B2 * 7/2013 Tanabe ..... A47B 43/00 211/186
2005/0145147 A1 * 7/2005 Costa ..... A47B 47/022 108/108
2005/0150850 A1 * 7/2005 Stitchick ..... A47B 47/022 211/90.03
2006/0091088 A1 * 5/2006 McCoy ..... H02G 3/30 211/60.1
2006/0213849 A1 * 9/2006 Bienick ..... A47B 96/028 211/90.02
2007/0034584 A1 * 2/2007 Park ..... A47B 57/265 211/187
2007/0108148 A1 * 5/2007 Stitchick ..... A47B 96/06 211/187
2007/0170138 A1 * 7/2007 Huang ..... A47B 47/0083 211/186
2007/0241072 A1 * 10/2007 Bryant ..... A47B 96/021 211/90.02
2007/0262037 A1 * 11/2007 Cheng ..... A47B 57/482 211/103
2008/0116156 A1 * 5/2008 Park ..... A47B 87/0207 211/59.2
2008/0296245 A1 * 12/2008 Punzel ..... A47B 47/021 211/153
2009/0120888 A1 * 5/2009 Himes ..... A47B 47/021 211/103
2009/0127413 A1 * 5/2009 Herron, III ..... A47B 57/42 248/220.21
2010/0213334 A1 * 8/2010 Davenport ..... A47B 57/16 248/220.21
2012/0255925 A1 * 10/2012 Fernandez ..... A47B 96/067 211/134
2013/0105426 A1 * 5/2013 Dyck ..... A47B 96/068 211/134
2013/0186847 A1 * 7/2013 Kramer ..... A47F 5/00 211/134
2014/0083959 A1 * 3/2014 Kalafut ..... A47F 5/0861 211/13.1

* cited by examiner

ADJUSTABLE CONTINUOUS SHELF MOUNTING SYSTEMS AND APPARATUSES RELATED THERETO

CROSS REFERENCE TO RELATED APPLICATIONS

This application claims priority to and the benefit of the filing date of U.S. Provisional Application No. 62/001,453, filed on May 21, 2014, entitled "ADJUSTABLE CONTINUOUS SHELF MOUNTING SYSTEMS AND APPARATUSES RELATED THERETO", which is hereby incorporated by reference in its entirety. Additionally, U.S. Provisional Application No. 62/100,091, filed on Jan. 6, 2015, entitled "ADJUSTABLE CONTINUOUS SHELF MOUNTING SYSTEMS AND APPARATUSES RELATED THERETO", is hereby incorporated by reference in its entirety.

FIELD OF THE INVENTION

This patent specification relates to the field of storage shelving. More specifically, this patent specification relates to storage shelving systems for providing adjustable continuous shelving.

BACKGROUND

Storage organizers, shelving units, and other storage systems are known in the art. These storage systems may be attached to a wall for structural support, or they may even be free standing and secured to a vertical surface for stability. Storage systems that are attached to walls and other vertical surfaces require a wall standard that secures to a wall and a shelf bracket that secures to the wall standard which supports a shelf. At a minimum, one shelf bracket and one wall standard are required to support each end of a shelf. However, due to the narrow width of wall studs, only one wall standard may be mounted into a single wall stud. For this reason, while shelves may be positioned on the same level, they do not form a continuous shelving surface as each shelf is supported solely by their respective two or more brackets in different wall studs. In order to secure a series of shelves in a level plane, a large number of brackets are required which can be expensive and time consuming to assemble.

Storage systems in the art also suffer from a lack of structural rigidity due to the single plate design and structure of their shelf brackets. These brackets are typically made from a single piece of material that is prone to torsional stress and failure as the weight on the shelf bracket is increased which limits the maximum weight that these storage systems can accommodate. If an uneven amount of weight is positioned on either the left side or the right side of a bracket, the single plate design of the bracket is unable to withstand the resultant torsional stress and the bracket may fail.

Another drawback common to storage systems common in the art is that multiple fasteners are required to secure a shelf to two or more shelf brackets. These fasteners increase the amount of time and effort required to assemble and disassemble prior art shelving systems.

Therefore, a need exists for novel adjustable continuous shelf mounting systems and apparatuses. There also exists a need for novel shelf mounting systems and apparatuses that are able to mount shelves with a reduced number of shelf brackets and wall standards allowing a single wall stud to support the ends of two shelves. There is a further need for a novel shelf mounting systems and apparatuses comprising shelf brackets that resist bending and/or twisting when weight is applied to one side creating torsional stress on the bracket. Finally, there exists a need for novel shelf mounting systems and apparatuses that have shelves and shelving brackets that are able to secure and engage to each other without requiring separate fasteners thereby facilitating assembly and disassembly.

BRIEF SUMMARY OF THE INVENTION

Adjustable continuous shelf mounting systems and apparatuses are provided. In some embodiments, an adjustable continuous shelving system may comprise: a wall standard comprising a plurality of upper slots and a plurality of lower slots in which the lower slots may be positioned below and proximate to the upper slots. The system may also include a support bracket comprising: a first support wing coupled to a first upper tongue configured to engage an upper slot of a wall standard and a first lower tongue configured to engage a lower slot of a wall standard; a second support wing coupled to a second upper tongue configured to engage an upper slot of a wall standard and a second lower tongue configured to engage a lower slot of a wall standard; and a shelf lip receiving valley formed between the first support wing and the second support wing. The system may further include a shelf comprising a load bearing surface and a perimeter lip coupled below the load bearing surface in which the perimeter lip of the shelf is configured to be received in the shelf lip receiving valley of the support bracket.

In further embodiments, the wall standard may comprise a set of slots configured to engage a bracket support to a wall standard, and a set of slots may comprise two upper slots and two lower slots. The two lower slots may be staggeredly offset relative to each other, and the first lower tongue and second lower tongue may be staggeredly offset allowing the first lower tongue to be inserted into one of the lower slots of the set and the second lower tongue to be inserted into the other of the lower slot of the set.

In still further embodiments, an upper slot may be defined by an upper slot top edge, an upper slot bottom edge, an upper slot distal elongate edge, and an upper slot medial elongate edge. The upper slot top edge may comprise a first length (L1) and an upper slot bottom edge may comprise a second length (L2). The L1 of the upper slot top edge may be greater than L2 of the upper slot bottom edge. The upper slot medial elongate edge may intersect with the upper slot bottom edge to form angle A, and angle A may be between 90 and 95 degrees. The upper slot distal elongate edge may intersect with the upper slot bottom edge to form angle B, and angle B is less than 90 degrees.

In still further embodiments, a lower slot may be defined by a lower slot top edge, a lower slot bottom edge, a lower slot distal elongate edge, and a lower slot medial elongate edge. The lower slot top edge may comprise a third length (L3) and a lower slot bottom edge may comprise a fourth length (L4). The L3 of the lower slot top edge may be greater than L4 of the lower slot bottom edge. The lower slot medial elongate edge may intersect with the lower slot bottom edge to form angle C, and angle C may be between 90 and 95 degrees. The lower slot distal elongate edge may intersect with the lower slot bottom edge to form angle D, and angle D may be less than 90 degrees.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
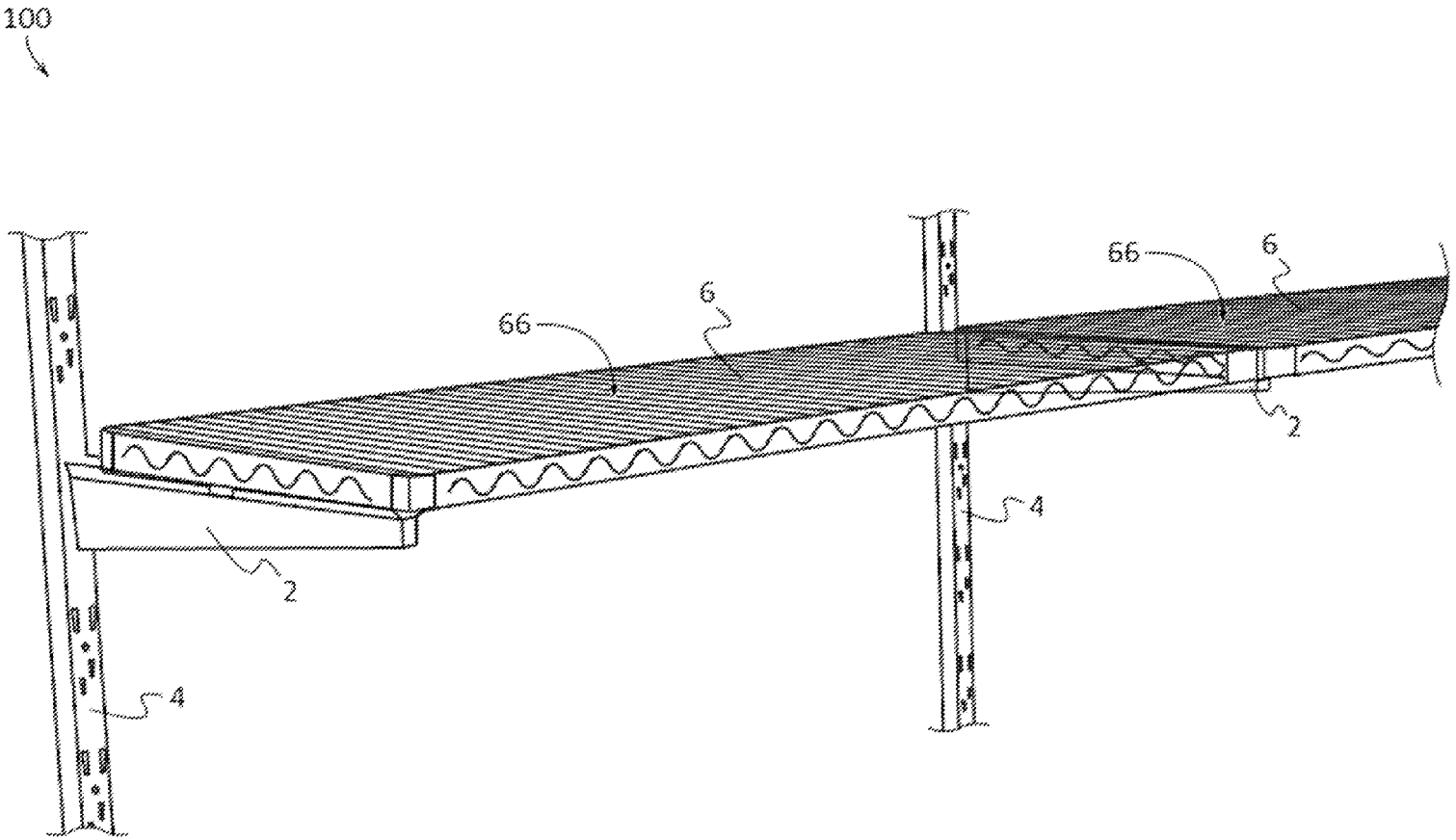
FIG. 1 depicts a perspective view of an example of an adjustable continuous shelf mounting system according to various embodiments described herein.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

New adjustable continuous shelf mounting systems and apparatuses are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 illustrates an example of an adjustable continuous shelf mounting system ("the system") 100 according to various embodiments. In this example, the system 100 comprises two support bracket apparatuses ("support brackets") 2, two wall standard apparatuses ("wall standards") 4, and two shelf apparatuses ("shelves") 6. In other embodiments, the system 100 may comprise any number of support brackets 2, wall standards 4, and shelves 6. The wall standards 4 are configured to be attached to a wall or other vertical surface with one or more fasteners such as nails, screws, bolts, anchors, adhesives, or any other type of suitable fastener. One or more support brackets 2 may engage and be secured to a wall standard 4. By engaging two or more support brackets 2 in a level plane to two or more wall standards 4, one or more shelves 6 may be placed on two or more support brackets 2 and be secured in a level orientation. In some embodiments, each support bracket 2 may be configured to support two shelves 6 allowing for shelves 6 to be placed adjacent to each other to form a continuous shelf surface. In further embodiments, a continuous shelf surface may be formed and supported by a number of support brackets 2 and wall standards 4 that each number one more than the number of shelves 6 they support. For example, three shelves 6 may be supported by four support brackets 2 and four wall standards 4, while seven shelves 6 may be supported by eight support brackets 2 and eight wall standards 4 with the shelves 6 aligned in the same plane to form a continuous shelving surface. In still further embodiments, a wall standard 4 may support two or more support brackets 2 and two or more shelves 6, allowing the wall standard to support two or more load bearing surfaces 66 of two or more shelves 6 to form a continuous shelving surface.

Figure 2:
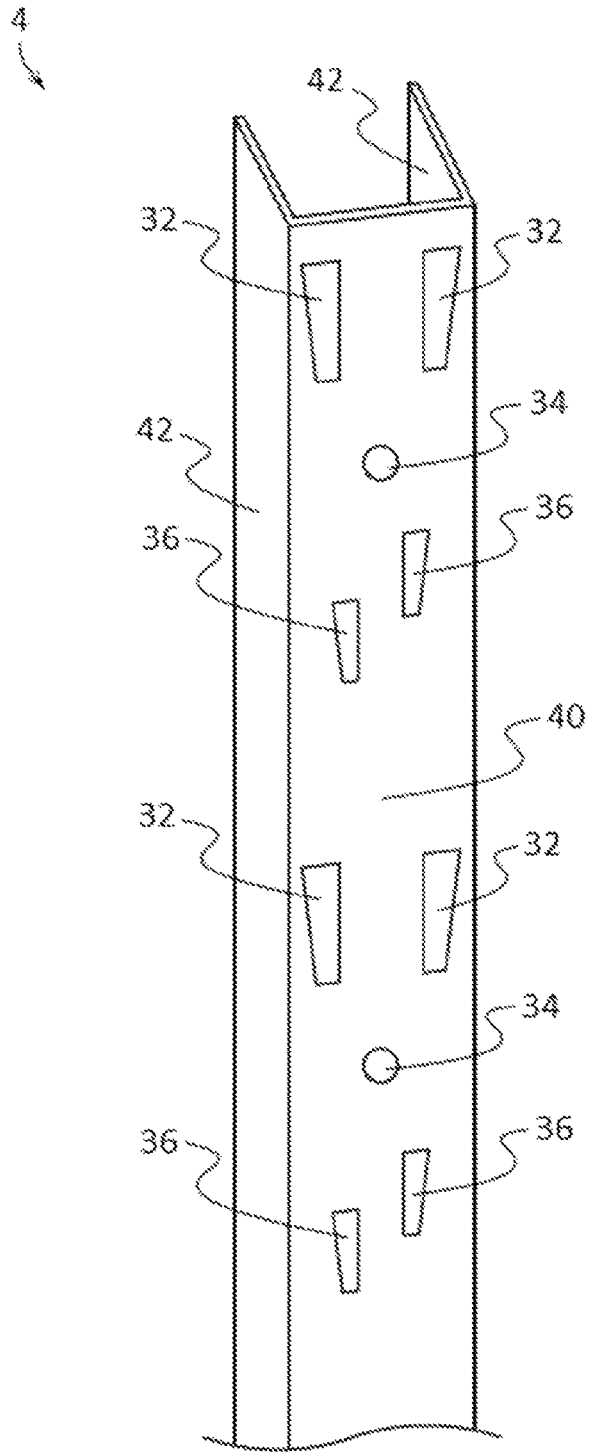
FIG. 2 illustrates a perspective view of an example of wall standard according to various embodiments described herein.

FIG. 2 illustrates a perspective view of an example of wall standard 4 according to various embodiments described herein. In this embodiment, the wall standard 4 comprises a wall standard face 40 joined to two wall standard side supports 42. Wall standard side supports 42 may be configured to contact a wall or other surface and maintain a space between the wall and the wall standard face 40. In further embodiments, a wall standard 4 may comprise a wall standard face 40 joined to two or more wall standard side supports 42.

Figure 4:
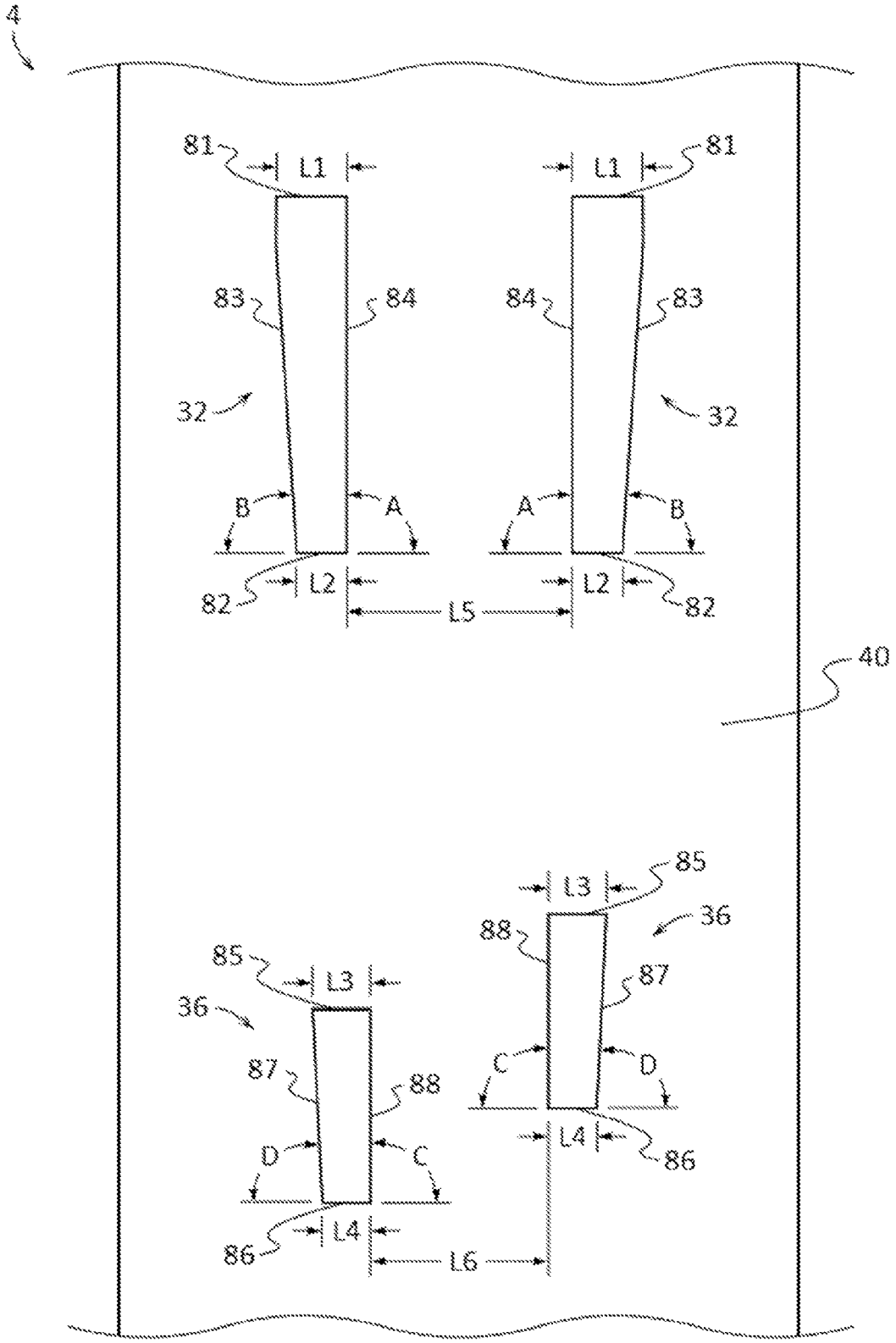
FIG. 4 depicts an enlarged partial perspective view of the example of a wall standard illustrated in FIG. 2 according to various embodiments described herein.

The wall standard face 40 comprises a plurality of slots or apertures which may be repeatedly positioned in sets along portions of the wall standard face 40. Each set of slots may be configured to engage with a support bracket 2. A set of slots configured to engage a support bracket 2 (FIGS. 1, and 6-10) may comprise two upper slots 32 and two lower slots 36. Multiple sets of two upper slots 32 and two lower slots 36 may be positioned along the wall standard face 40 with each configured to engage a support bracket 2. In some embodiments, the two lower slots 36 of a set of slots may be staggeredly offset from each other as shown in FIGS. 2 and 4. In other embodiments, the two upper slots 32 of a set of slots may be staggeredly offset from each other. Additionally, one or more mounting screw apertures 34 and/or mounting bolt shank apertures 38 may be positioned along the wall standard face 40 which may be configured to receive screw type, bolt type, or any other type of fastener suitable for attaching a wall standard 4 to a wall.

Figure 3:
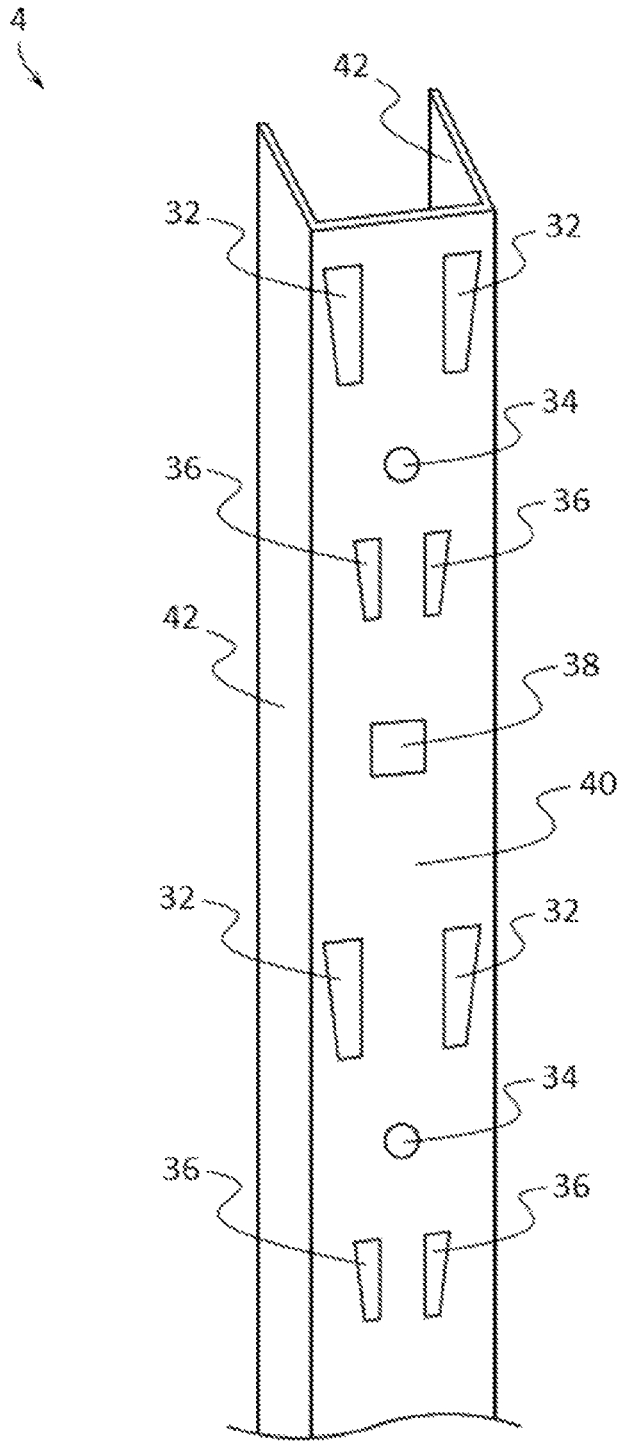
FIG. 3 shows a perspective view of an alternative example of wall standard according to various embodiments described herein.
Figure 5:
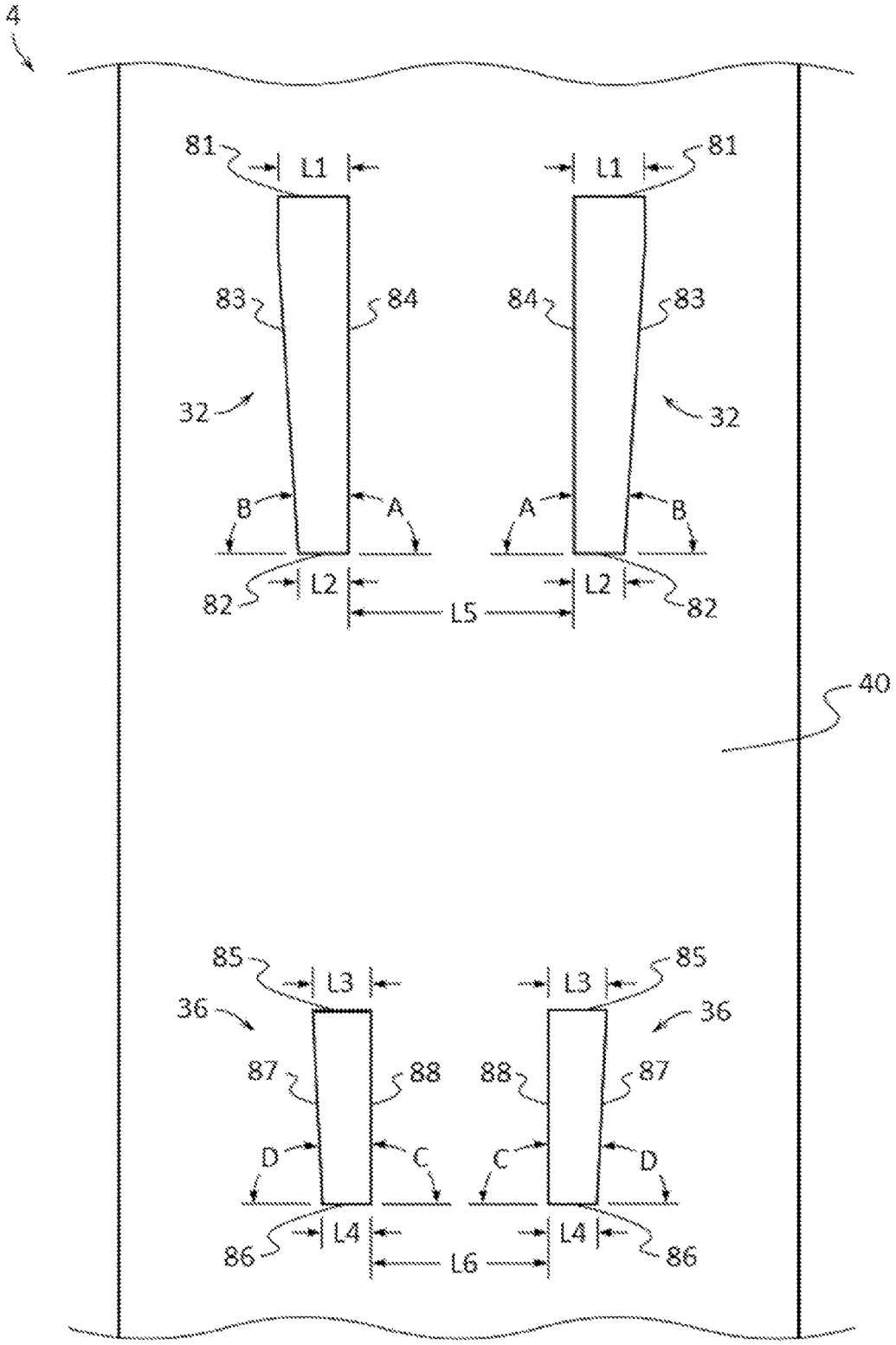
FIG. 5 illustrates an enlarged partial perspective view of the alternative example of wall standard shown in FIG. 3 according to various embodiments described herein.

Turning now to FIG. 3, a perspective view of an alternative example of wall standard 4 according to various embodiments is shown. In this embodiment, the wall standard 4 comprises a wall standard face 40 joined to two wall standard side supports 42 with a plurality of slots or apertures which may be repeatedly positioned in sets along portions of the wall standard face 40 and which are configured to engage with a support bracket 2. A set of slots configured to engage a support bracket 2 (FIGS. 1, and 6-10) may comprise two upper slots 32 and two lower slots 36. Multiple sets of two upper slots 32 and a lower slot 36 may be positioned along the wall standard face 40 each configured to engage a support bracket 2 (FIG. 1). In some embodiments, the two lower slots 36 of a set of slots may be positioned so as to generally mirror each other as shown in FIGS. 3 and 5. Additionally, one or more mounting screw apertures 34 and/or mounting bolt shank apertures 38 may be positioned along the wall standard face 40 which are configured to receive screw type, bolt type, or any other type of fastener suitable for attaching a wall standard 4 to a wall.

Referring now to FIGS. 4 and 5, the wall standard face 40 comprises a plurality of slots or apertures which may be repeatedly positioned in sets along portions of the wall standard face 40. Each set of slots may be configured to engage with a support bracket 2. A set of slots configured to engage a support bracket 2 may comprise two upper slots 32 and two lower slots 36. The upper slots 32 may be larger than the lower slots 36. In some embodiments, the upper slots 32 may mirror each other in dimensions and positioning and the lower slots 36 may mirror each other in dimensions but also be staggeredly offset relative to each other in positioning so that one of the lower slots 36 is closer to the upper slot 32 on a first bracket side support 8 than the other lower slot 36 is to the upper slot 32 on the second bracket side support 8 as illustrated in FIGS. 2 and 4. In other embodiments, the upper slots 32 may mirror each other in dimensions and positioning and the lower slots 36 may also mirror each other in dimensions and positioning so that both of the lower slots 36 are substantially equidistant from the upper slots 32 as illustrated in FIGS. 3 and 5.

An upper slot 32 may be defined by an upper slot top edge 81, an upper slot bottom edge 82, an upper slot distal elongate edge 83, and an upper slot medial elongate edge 84. Both the upper slot distal elongate edge 83 and the upper slot medial elongate edge 84 may be greater in length than the upper slot top edge 81 and the upper slot bottom edge 82. The upper slot medial elongate edge 84 may be generally positioned closer the longitudinal center of the wall standard front face 40 than the upper slot distal elongate edge 83. An upper slot top edge 81 may comprise a first length (L1) and an upper slot bottom edge 82 may comprise a second length (L2). In some embodiments, the L1 of the upper slot top edge 81 may be greater than the L2 of the upper slot bottom edge 82. In other embodiments, the L2 of the upper slot bottom edge 82 may be greater than the L1 of the upper slot top edge 81.

The upper slot medial elongate edge 84 may intersect with the upper slot bottom edge 82 to form angle A. In some embodiments, angle A may be a substantially right angle of between 89 to 91 degrees. In other embodiments, angle A may be between 90 and 95 degrees. The upper slot distal elongate edge 83 may also intersect with the upper slot bottom edge 82 to form angle B. In some embodiments, angle B may be a substantially right angle of between 89 to 91 degrees. In other embodiments, angle B may be less than 90 degrees. In further embodiments, angle B may be between 88 and 89 degrees. In still further embodiments, angle A may be approximately 90 degrees and angle B may be approximately 88.5 degrees.

A lower slot 36 may be defined by a lower slot top edge 85, a lower slot bottom edge 86, a lower slot distal elongate edge 87, and a lower slot medial elongate edge 88. Both the lower slot distal elongate edge 87 and the lower slot medial elongate edge 88 may be greater in length than the lower slot top edge 85 and the lower slot bottom edge 86. The lower slot medial elongate edge 88 may be generally positioned closer the longitudinal center of the wall standard front face 40 than the lower slot distal elongate edge 87. A lower slot top edge 85 may comprise a third length (L3) and a lower slot bottom edge 86 may comprise a fourth length (L4). In some embodiments, L3 of the lower slot top edge 85 may be greater than L4 of the lower slot bottom edge 86. In other embodiments, L4 of the lower slot bottom edge 86 may be greater than L3 of the lower slot top edge 85.

The lower slot medial elongate edge 88 may intersect with the lower slot bottom edge 86 to form angle C. In some embodiments, angle C may be a substantially right angle of between 89 to 91 degrees. In other embodiments, angle C may be between 90 and 95 degrees. The lower slot distal elongate edge 87 may also intersect with the lower slot bottom edge 86 to form angle D. In some embodiments, angle D may be a substantially right angle of between 89 to 91 degrees. In other embodiments, angle D may be less than 90 degrees. In further embodiments, angle D may be between 88 and 89 degrees. In still further embodiments, angle C may be approximately 90 degrees and angle D may be approximately 88.5 degrees.

In some embodiments, the lower slots 36 may be staggeredly offset relative to each other in positioning so that one of the lower slots 36 is closer to the upper slot 32 on a first bracket side support 8 than the other lower slot 36 is to the upper slot 32 on the second bracket side support 8 as illustrated in FIGS. 2 and 4. In some embodiments, a lower slot 36 may be staggered from the other lower slot 36 a distance of approximately 1% to 800% the length of the lower slot medial elongate edge 88 of the lower slot 36. In further embodiments, a lower slot 36 may be staggered from the other lower slot 36 a distance of approximately 25% to 75% the length of the lower slot medial elongate edge 88 of the lower slot 36.

Figure 6:
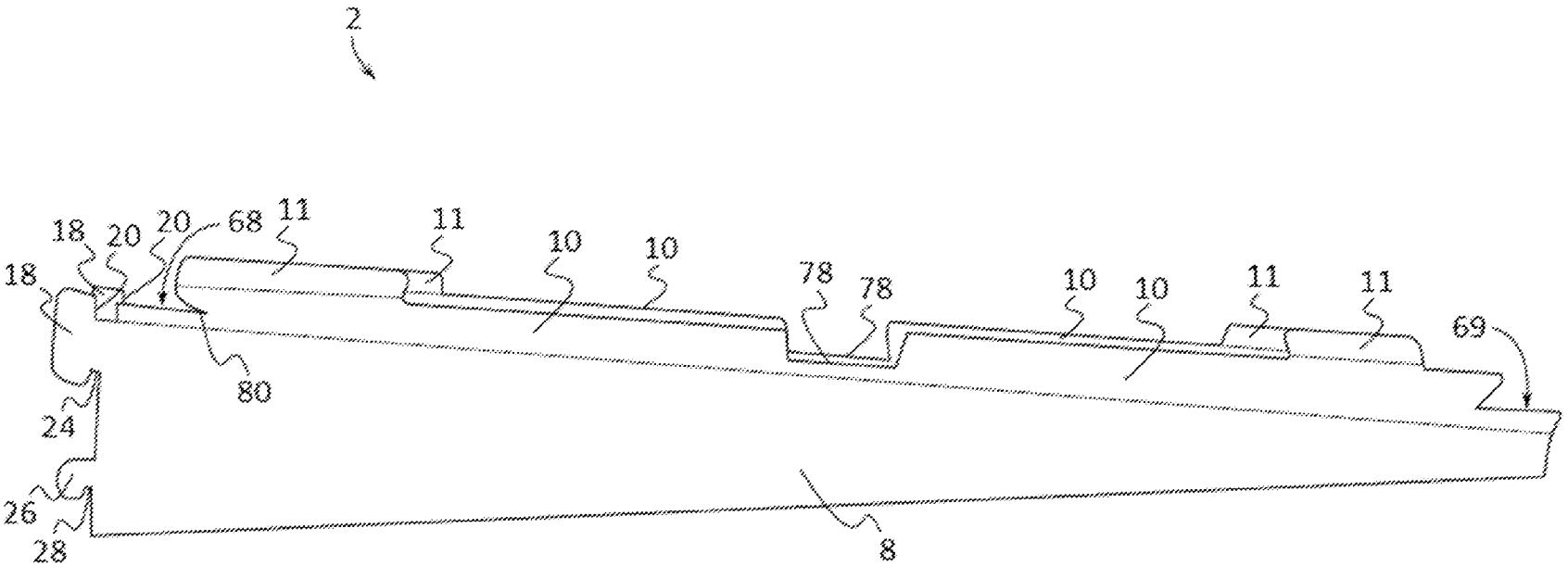
FIG. 6 shows a side perspective view of an example of a support bracket according to various embodiments described herein.

In some embodiments, the upper slots 32 may be spaced apart from each other a distance that is greater than the distance the lower slots 36 are spaced apart from each other. The two upper slots 32 may be separated from each other by a fifth distance (L5) which may be measured as the distance between the upper slot medial elongate edge 84 of a first upper slot 32 and the upper slot medial elongate edge 84 of a second upper slot 32 as shown in FIGS. 5 and 6. The two lower slots 36 may be separated from each other by a sixth distance (L6) which may be measured as the distance between the lower slot medial elongate edge 88 of a first lower slot 36 and the lower slot medial elongate edge 88 of a second lower slot 36 as shown in FIGS. 5 and 6. In some embodiments, L5 of the upper slots 32 may be greater than the L6 of the lower slots 32. In further embodiments, L5 of the upper slots 32 may be between 1% and 300% greater than the L6 of the lower slots 32. In other embodiments, L5 of the upper slots 32 may be approximately the same as the L6 of the lower slots 32. In still other embodiments, L6 of the lower slots 32 may be greater than the L5 of the upper slots 32.

A wall standard 4 may be made from durable materials such as hard plastics, metal alloys, wood, hard rubbers, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, a wall standard face 40 may be joined to two wall standard side supports 42 by being integrally molded or formed together, chemically bonded, heat bonded, or otherwise joined.

Figure 7:
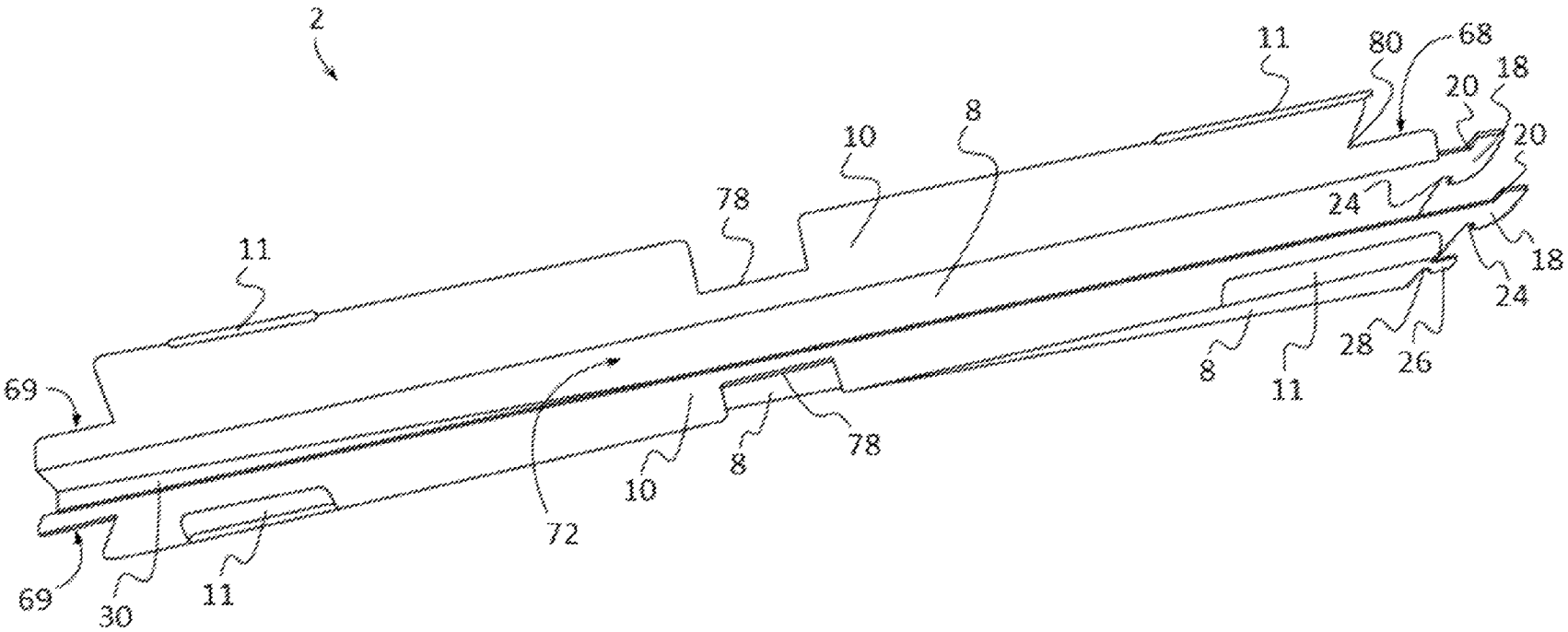
FIG. 7 depicts a top perspective view of an example of a support bracket according to various embodiments described herein.
Figure 8:
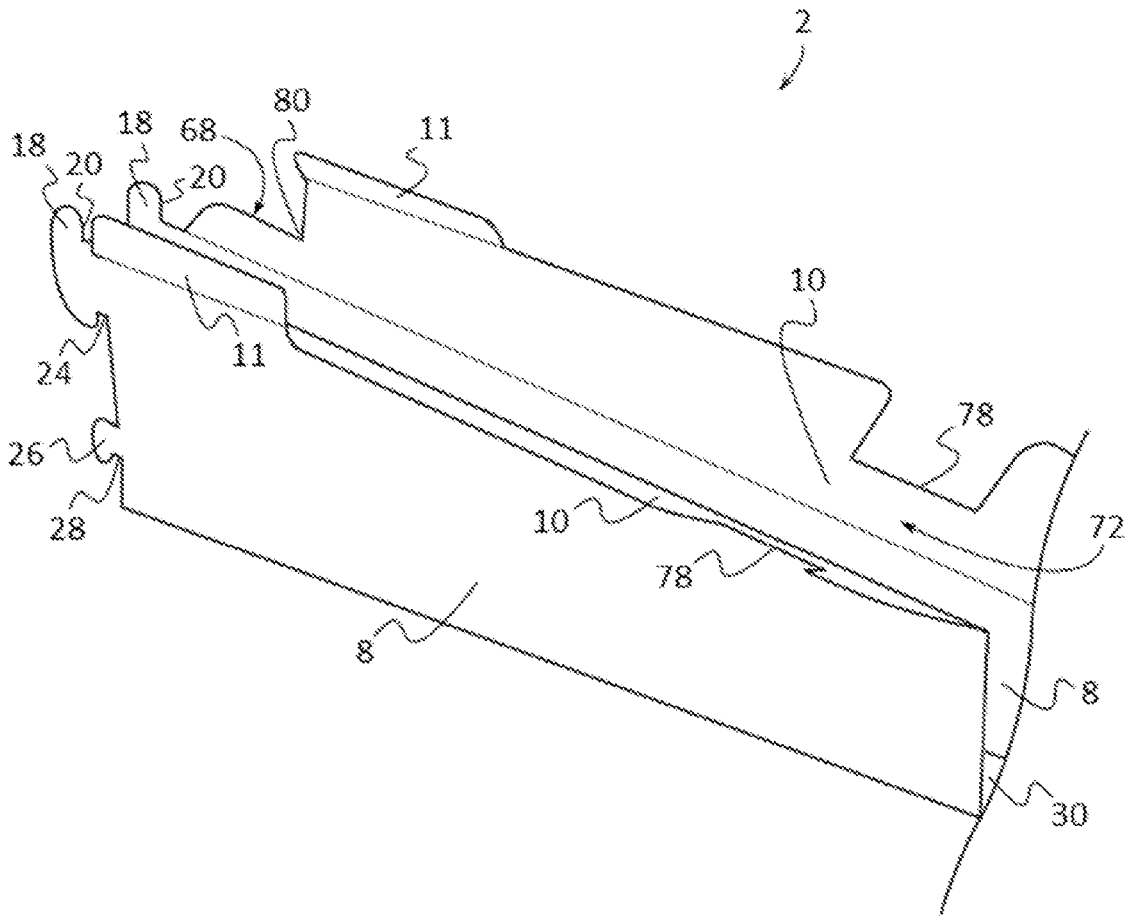
FIG. 8 illustrates a top partial perspective view of an example of a support bracket according to various embodiments described herein.

Turning now to FIGS. 6-8 an example of a support bracket 2 according to various embodiments described herein. In this embodiment, the support bracket 2 comprises a support wing 10 coupled to an upper tongue 18 configured to engage an upper slot 32 of a wall standard 4 and a lower tongue 26 configured to engage a lower slot 36 of a wall standard 4. In further embodiments, a support bracket 2 may comprise a first support wing 10 coupled to a first upper tongue 18 configured to engage an upper slot 32 of a wall standard 4 and a first lower tongue 26 configured to engage a first lower slot 36 of a wall standard 4; a second support wing 10 coupled to a second upper tongue 18 configured to engage an upper slot 32 of a wall standard 4 and a second lower tongue 26 configured to engage a second lower slot 36 of a wall standard 4; and a shelf lip receiving valley 72 formed between the first support wing 10 and the second support wing 10.

In some embodiments, a support bracket 2 may comprise a bracket side support 8 which may be configured to couple a support wing 10 to an upper tongue 18 and to a lower tongue 26. In further embodiments, a support bracket 2 may comprise a first bracket side support 8 which may be configured to couple a first support wing 10 to a first upper tongue 18 and to a first lower tongue 26, and the support bracket 2 may also comprise a second bracket side support 8 which may be configured to couple a second support wing 10 to a second upper tongue 18 and to a second lower tongue 26. The first support wing 10 and second support wing 10 may then be coupled together with a support bracket base 30 which may extend the length of the support bracket 2. The first support wing 10 and second support wing 10 may be angled away from each other to form a shelf lip receiving valley 72. The shelf lip receiving valley 72 may be configured to receive a portion of the perimeter lip 52 (FIG. 9) from a first shelf 6 (FIG. 1) and a portion of the perimeter lip 52 from a second shelf 6 allowing a support bracket 2 comprising two support wings 10 to receive two adjacent shelves 6 to form continuous shelving surface as shown in FIG. 1. In some embodiments, a first support wing 10 and second support wing 10 may be angled away from each other to form a shelf lip receiving valley 72 with a width that is greater than the combined width of a perimeter lip 52 from a first shelf 6 and a perimeter lip 52 from a second shelf 6.

In some embodiments, a support wing 10 may include a rear shelf retaining groove 80 positioned proximate to an upper tongue 18. A rear shelf retaining groove 80 may comprise a rear shelf support surface 68 which extends into the support wing 10 so that the support wing 10 is positioned above the rear shelf support surface 68 to form a rear shelf retaining groove 80. The rear shelf support surface 68 may be configured to receive portions of a shelf 6 (FIGS. 1 and 9) such as portions of the perimeter lip 52 (FIG. 9) and/or corner gusset 56 (FIG. 9) thereby allowing the rear shelf support surface 68 to support a corner of a shelf 6. Once resting on the rear shelf support surface 68, the shelf 6 may be prevented from inadvertently sliding forward (away from the wall standard 4) and off of a support bracket 2 by the contact between the rear shelf retaining groove 80 with portions of the perimeter lip 52 and/or corner gusset 56 of the shelf 6.

Figure 9:
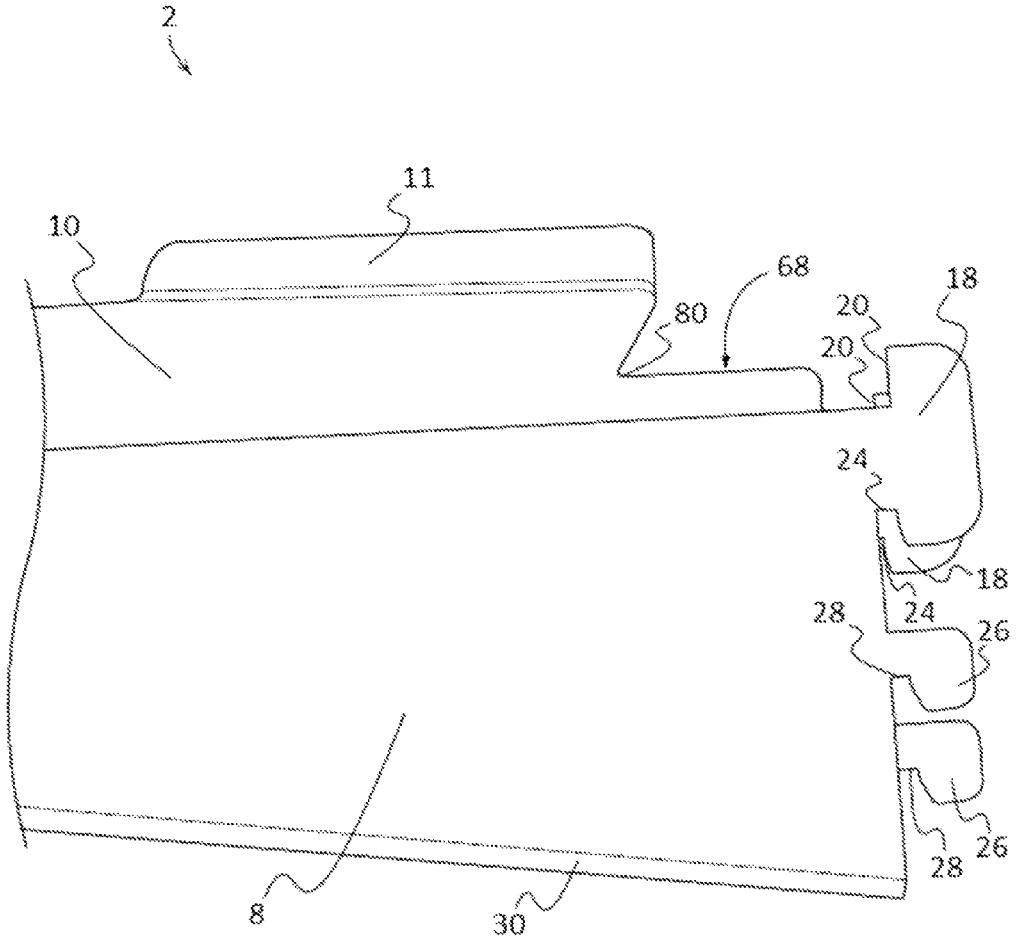
FIG. 9 shows a bottom partial perspective view of an example of a support bracket according to various embodiments described herein.

A support wing 10 may further include a front shelf support surface 69 positioned a distance away from the rear shelf support surface 68 a distance that is generally similar to the distance between two opposing sides of a shelf 6 (FIGS. 1 and 9). The front shelf support surface 69 may be configured to receive portions of a shelf 6 (FIGS. 1 and 9) such as portions of the perimeter lip 52 (FIG. 9) and/or corner gusset 56 (FIG. 9) thereby allowing the front shelf support surface 69 to support a corner of a shelf 6. Once a support bracket 2 is engaged to a wall standard 4, a rear shelf support surface 68 and a front shelf support surface 69 may each contact and support portions of the perimeter lip 52 and/or a corner gusset 56 of the shelf 6 thereby supporting one side of the shelf 6 in a generally level manner.

In some embodiments, a support wing 10 may comprise an optional truss relief groove 78. One or more optional truss relief grooves 78 may be positioned on a support wing 10 and may be configured to receive portions of a shelf 6 (FIGS. 1 and 9) such as an optional truss support 76 (FIG. 9) to allow a shelf 6 comprising an optional truss support 76 to be supported in a generally level orientation by one or more support brackets 2.

A support bracket 2 may be secured to a wall standard 4 (FIGS. 1-5) by inserting the two lower tongues 26 and two upper tongues 18 into a set of two lower slots 36 and two upper slots 32, respectively, on a wall standard 4 allowing the two lower tongues 26 and two upper tongues 18 to enter the space between the wall and the wall standard face 40 (FIGS. 2-5). An upper tongue 18 may comprise an upper tongue groove 24 and an upper tongue safety catch 20. An upper tongue safety catch 20 may extend up from the upper tongue 18. The upper tongue safety catch 20 may be configured to catch onto the upper slot top edge 81 of an upper slot 32 to prevent the upper tongue 18 from being inserted or removed from an upper slot 32 unless the end of the support bracket 2 opposite to the upper tongue 18 is tilted or lifted above the upper tongue 18. An upper tongue groove 24 may extend into the upper tongue 18 towards the upper tongue safety catch 20. The upper tongue groove 24 may be configured to catch onto and be supported by the upper slot bottom edge 82 of an upper slot 32 to prevent the upper tongue 18 from being removed from an upper slot 32 unless the upper tongue 18 is lifted to disengage the upper slot bottom edge 82 from resting in the upper tongue groove 24.

A lower tongue 26 may comprise a lower tongue groove 28 which may extend into the lower tongue 26 towards the upper tongue 18. In some embodiments, the upper tongues 32 may be larger than the lower tongues 36. The lower tongue groove 28 may be configured to catch onto and be supported by the lower slot bottom edge 86 of a lower slot 36 to prevent the lower tongue 26 from being removed from a lower slot 36 unless the lower tongue 26 is lifted to disengage the lower slot bottom edge 86 from resting in the lower tongue groove 28.

The lower tongue grooves 26 and upper tongue grooves 24 may each engage onto a lower slot bottom edge 86 and onto an upper slot bottom edge 82, respectively, to engage a support bracket 2 to a wall standard 4 by the action of gravity and weight positioned onto the support bracket 2.

By positioning the upper tongues 18 towards the top of the support bracket 2 proximate to a support wing 10 and the lower tongues 26 towards the bottom of the support bracket 2 below the upper tongues 18, when inserted into upper slots 32 and lower slots 36, respectively, on a wall standard 4, a very strong torsional force resisting connection is created. In some embodiments, the upper slots 32 and a lower slot 36 precisely match the shape of the upper tongues 18 and lower tongue 26 on a support bracket 2 thereby increasing the strength of the torsional force resisting connection.

To remove a support bracket 2 from a wall standard 4, the support bracket 2 may be lifted until the lower tongue grooves 26 and upper tongue grooves 24 may each disengage from a lower slot bottom edge 86 of the lower slots 36 and from an upper slot bottom edge 82 of the upper slots 32, respectively, allowing the lower tongues 26 and upper tongues 18 to be pulled out and away from the wall standard 4. Optionally, one or more upper tongue safety catches 20 may be configured to provide an interfering surface that will not allow the support bracket 2 to accidently become disengaged from the wall standard 4 when bumped or jostled so that the end of the support bracket 2 opposite to the upper tongue 18 must tilted or lifted above the upper tongue 18 in addition to lifting the lower tongue grooves 26 and upper tongue grooves 24 away from the lower slot bottom edges 86 and upper slot bottom edges 82, respectively, before the support bracket 2 can be disengaged from a wall standard 4.

As shown in FIGS. 6-10, a support wing 10 may comprise one or more support wing safety catch tabs 11. In some embodiments, a support wing safety catch tab 11 may be positioned on a support wing 10 proximate to a rear shelf supporting surface 68 and a second support wing safety catch tab 11 may be positioned on the support wing 10 proximate to a front shelf supporting surface 69. A support wing safety catch tab 11 may extend above the support wing 10 allowing the support wing safety catch tab 11 to catch onto a portion of a shelf 6 (FIGS. 1 and 11) to prevent the shelf 6 from inadvertently sliding sideways off of a support bracket 2. A support wing safety catch tab 11 may be configured to extend above the rear shelf supporting surface 68 and front shelf supporting surface 69 so that the support wing safety catch tab 11 may catch onto the perimeter lip 52 (FIG. 11) or other element of a shelf 6 to catch the shelf 6 from completely separating from the support bracket 2 as the shelf 6 moves sideways off of the support bracket 2. In a similar manner, the rear shelf supporting surface 68 and front shelf supporting surface 69 may catch onto a corner gusset 56 (FIG. 11) and/or perimeter lip 52 of a shelf 6 to catch the shelf 6 from completely separating from the support bracket 2 as the shelf 6 moves forwards or backwards off of the support bracket 2.

FIG. 9 depicts a bottom partial perspective view of an example of a support bracket 2 according to various embodiments described herein. In some embodiments, the lower tongues 26 may be configured to be in a staggeredly offset position on the bracket side supports 8 relative to each other so that one lower tongue 26 is relatively closer to an upper tongue 18 compared to the other lower tongue 26. This example of a support bracket 2 comprising staggered lower tongues 26 may be configured to be used with the example of a wall standard 4 comprising staggered lower slots 36 as shown in FIGS. 2 and 4. In some embodiments, a lower tongue 26 may be staggered from the other lower tongue 26 a distance of approximately 1% to 800% the length of the lower slot medial elongate edge 88 of the lower slot 36. In further embodiments, a lower tongue 26 may be staggered from the other lower tongue 26 a distance of approximately 25% to 75% the length of the lower slot medial elongate edge 88 of the lower slot 36.

Figure 10:
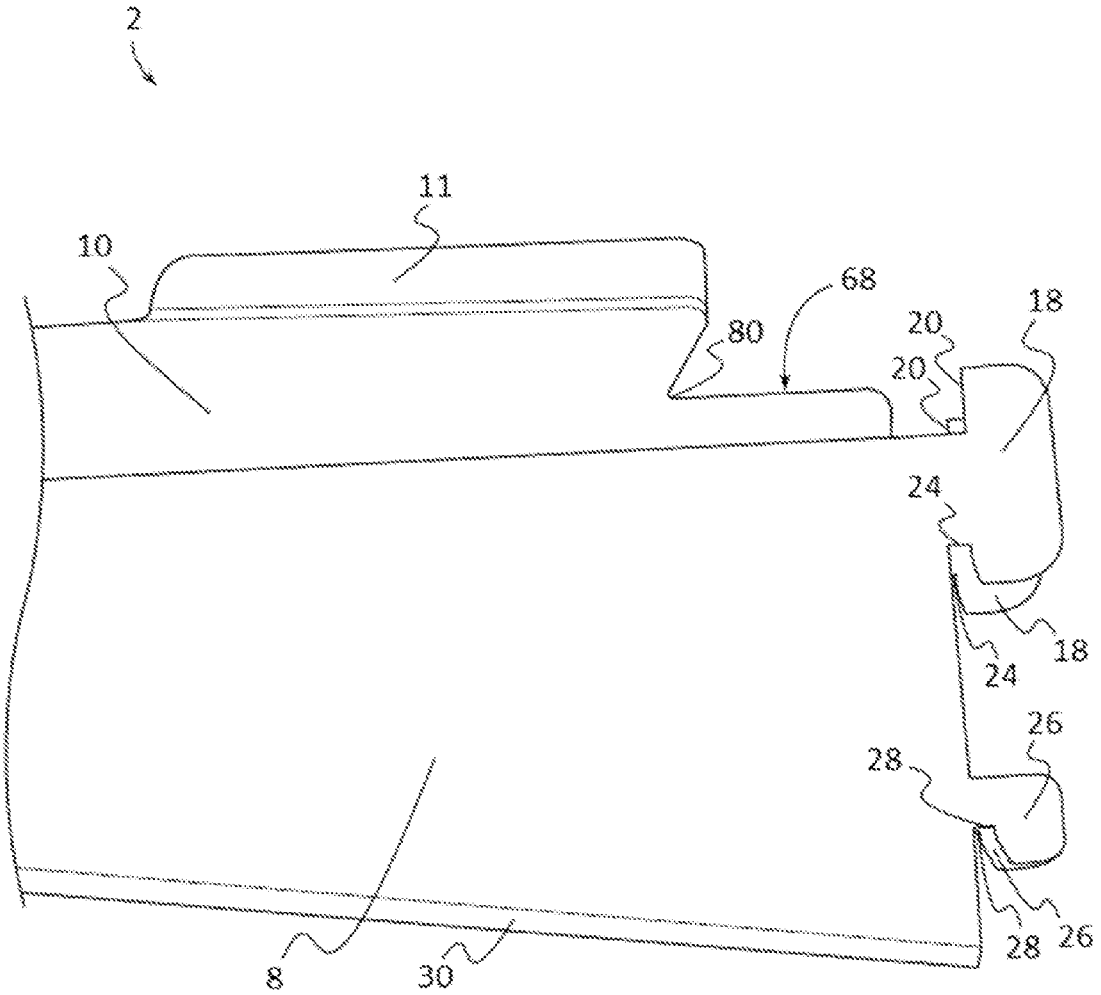
FIG. 10 depicts a bottom partial perspective view of an alternative example of a support bracket according to various embodiments described herein.

FIG. 10 illustrates a bottom partial perspective view of an alternative example of a support bracket 2 according to various embodiments described herein. In some embodiments, the lower tongues 26 may be configured to generally mirror each other in position relative to each other on the bracket side supports 8 so that each lower tongue 26 is relatively the same distance to the upper tongue 18 on both bracket side supports 8. This example of a support bracket 2 comprising two lower tongues 26 which generally mirror each other in positioning on each bracket side support 8 may be configured to be used with the example of a wall standard 4 comprising mirrored lower slots 36 as shown in FIGS. 3 and 5.

Figure 11:
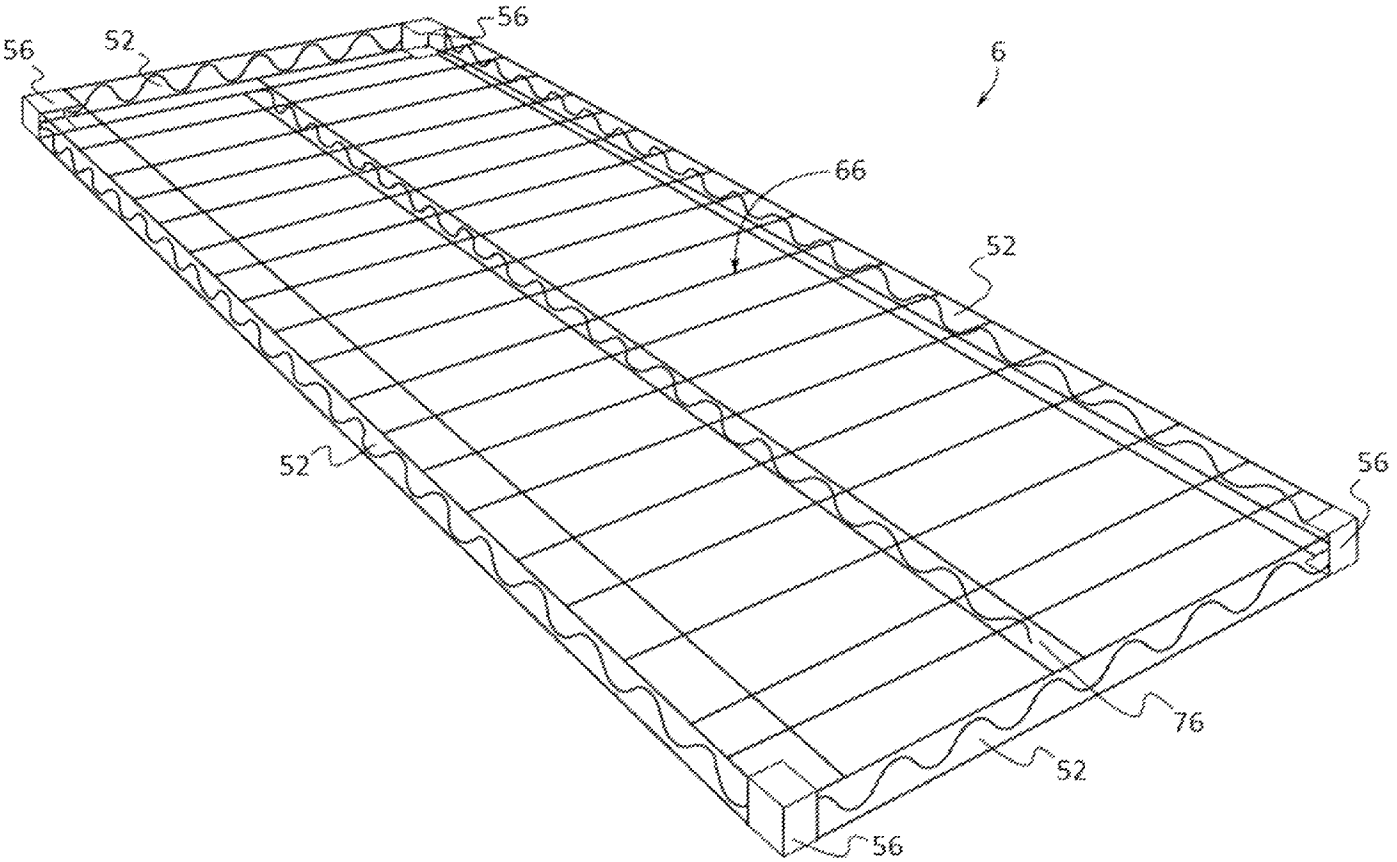
FIG. 11 illustrates a top perspective view of an example of a shelf according to various embodiments described herein.

FIG. 11 shows a top perspective view of an example of a shelf according to various embodiments described herein. A shelf 6 may comprise a load bearing surface 66 and a perimeter lip 52 coupled the load bearing surface 66. In some embodiments, the shelf 6 and the perimeter lip 52 may comprise four sides with a corner gusset 56 positioned in each corner of the perimeter lip 52. In further embodiments, a shelf 6 may comprise a wire frame structure which may allow the load bearing surface 66 and/or perimeter lip 52 to be permeable to air, water, small objects, and the like. In other embodiments, the load bearing surface 66 and/or perimeter lip 52 may comprise a generally solid structure which may be formed by sheets of metal, wood, plastic, or any other suitable material.

In some embodiments, a perimeter lip 52 may extend away from and surround the perimeter of the bottom of the load bearing surface 66 of the shelf 6. The perimeter lip 52 may also be configured to engage to a rear shelf support surface 68 (FIGS. 6-10) and/or front shelf support surface 69 (FIGS. 6-7) of a support bracket 2 (FIGS. 1, 6-10). In further embodiments, a shelf 6 may be supported by the contact of the perimeter lip 52 with both a rear shelf support surface 68 and a front shelf support surface 69 of a first support bracket 2 and also by the contact of the perimeter lip 52 with both a rear shelf support surface 68 and a front shelf support surface 69 of a second support bracket 2.

A shelf may optionally comprise one or more corner gussets 56. A corner gusset 56 may structurally reinforce an angular corner of the perimeter lip 52 and/or structurally reinforce the coupling of the perimeter lip 52 to the load bearing surface 66 thereby augmenting the weight bearing capacity of the shelf 6. In some embodiments, a corner gusset 56 may comprise a generally planar shape which may be configured to contact a rear shelf support surface 68 (FIGS. 6-10) or a front shelf support surface 69 (FIGS. 6-7) of a support bracket 2 (FIGS. 1, 6-10). In further embodiments, a shelf 6 may comprise four corner gussets 56 with a corner gusset 56 positioned in one or more of the angular corners of the perimeter lip 52. In still further embodiments, the perimeter lip 52 of the shelf 6 may be configured to slidably engage with the shelf lip receiving valley 72 (FIGS. 7 and 8) of a support bracket 2 (FIGS. 1, 6-10). In further embodiments, the slidable engagement movement may be limited by the contact of the perimeter lip 52 and/or a corner gusset 56 with a rear shelf support surface 68 or front shelf support surface 69 of a support bracket 2.

In some embodiments, a shelf 6 may comprise one or more optional truss supports 76. An optional truss support 76 may be coupled to or positioned adjacent to the perimeter lip 52 and may be configured to contact portions of the load bearing surface 66 to provide structural support and rigidity to the shelf 6. In some embodiments, an optional truss support 76 may be positioned on a shelf 6 so as to be received by an optional truss relief groove 78 on a bracket support 2. In some embodiments, an optional truss support 76 may comprise a wire frame structure which may allow a truss support 76 to be permeable to air, water, small objects, and the like.

While some materials have been provided, in other embodiments, the elements that comprise apparatuses of the system 100 such as the support bracket apparatus 2, the wall standard apparatus 4, and the shelf apparatus 6 may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements of the apparatuses may be made from or comprise durable and slightly flexible materials such as soft plastics, silicone, soft rubbers, or any other suitable materials including combinations of materials. In some embodiments, one or more of the elements that comprise the apparatuses of the system 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatuses may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the apparatuses may be coupled by being one of connected to and integrally formed with another element of an apparatus of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An adjustable continuous shelf mounting system, the system comprising:

a shelf having a length and a width, the shelf comprising a load bearing surface and a perimeter lip coupled below the load bearing surface;

a wall standard comprising a plurality of upper slots and a lower slot with said lower slots positioned below and proximate to said upper slots;

a support bracket having a length that corresponds to the width of the shelf, the support bracket comprising at least one lower tongue configured to be inserted into a corresponding lower slot of the wall standard;

a first side wall having a first upper tongue extending from a rear of the first side wall, wherein the first upper tongue is configured to be inserted in a corresponding upper slot of the wall standard, wherein a first support wing protrudes upwardly and diagonally from an upper edge of the first side wall along substantially the entire length of the support bracket;

a second side wall having a second upper tongue extending from a rear of the second side wall, wherein the second upper tongue is configured to be inserted in a corresponding upper slot of the wall standard, wherein a second support wing protrudes upwardly and diagonally from an upper edge of the second side wall along substantially the entire length of the support bracket; wherein the second side wall is generally parallel to the first side wall; and a shelf lip receiving recess formed in the support bracket;

wherein the load boring surface, wherein the load bearing surface of the shelf is configured to rest upon the support wings and the perimeter lip of the shelf is configured to be received in the shelf lip receiving recesses of the support bracket.

2. The system of claim 1, wherein a shelf lip receiving valley defined between the shelf lip receiving recesses of the support bracket, the shelf lip receiving valley is configured to receive a perimeter lip from the shelf and a perimeter lip from a second shelf.

3. The system of claim 1, wherein the first support wing includes a first support wing safety catch tab extending away form the first support wing, and wherein the second support wing includes a second support wing safety catch tab extending away from the second support wing.

4. The system of claim 3, wherein the first support wing safety catch tab is configured to prevent the shelf from sliding sideways off of the support bracket and the second support wing safety catch tab is configured to prevent a second shelf from sliding sideways off of the support bracket.

5. The system of claim 1, wherein the perimeter lip extends around and below a perimeter of the load bearing surface.

6. The system of claim 5, wherein the perimeter lip comprises four sides and four corners with a corner gusset positioned in each of the four corners.

7. The system of claim 2, wherein the first and second support wings each comprise a rear shelf support surface.

8. The system of claim 7, wherein the rear shelf support surfaces are configured to support a first corner gusset and the shelf lip receiving valley is configured to support a second corner gusset.

9. The system of claim 1, wherein the wall standard comprises a set of slots configured to mount the support bracket support to the wall standard, and wherein the set of slots comprises two upper slots and two lower slots.

10. The system of claim 9, wherein the two lower slots of the set of slots are staggeredly offset relative to each other, and wherein the at least one lower tongue includes a first lower tongue and a second lower tongue of the support bracket are staggeredly offset allowing the first lower tongue to be inserted into one of the lower slots of the set and the second lower tongue to be inserted into the other of the lower slot of the set.

11. The system of claim 1, wherein a corresponding upper slot is defined by an upper slot top edge, an upper slot bottom edge, an upper slot distal elongate edge, and an upper slot medial elongate edge.

12. The system of claim 11, wherein the upper slot top edge comprises a first length (L1) and an upper slot bottom edge comprises a second length (L2), and wherein L1 of the upper slot top edge is greater than L2 of the upper slot bottom edge.

13. The system of claim 11, wherein the upper slot medial elongate edge intersects with the upper slot bottom edge to form angle A, and wherein angle A is between 90 and 95 degrees.

14. The system of claim 11, wherein the upper slot distal elongate edge intersects with the upper slot bottom edge to form angle B, and wherein angle B is less than 90 degrees.

15. The system of claim 1, wherein a corresponding lower slot is defined by a lower slot top edge, a lower slot bottom edge, a lower slot distal elongate edge, and a lower slot medial elongate edge.

16. The system of claim 15, wherein the lower slot top edge comprises a third length (L3) and a lower slot bottom edge comprises a fourth length (L4), and wherein L3 of the lower slot top edge is greater than L4 of the lower slot bottom edge.

17. The system of claim 15, wherein the lower slot medial elongate edge intersects with the lower slot bottom edge to form angle C, and wherein angle C is between 90 and 95 degrees.

18. The system of claim 15, wherein the lower slot distal elongate edge intersects with the lower slot bottom edge to form angle D, and wherein angle D is less than 90 degrees.

19. The system of claim 1, wherein a first and a second upper slot are separated by a fifth distance (L5) and a first and a second lower slot are separated by a sixth distance (L6), and wherein the L5 of the upper slots is greater than the L6 of the lower slots.

* * * * *